United States Patent [19]

Uhri

[11] Patent Number: 4,527,836

[45] Date of Patent: Jul. 9, 1985

[54] DEEP WELL PROCESS FOR SLURRY PICK-UP IN HYDRAULIC BOREHOLE MINING DEVICES

[75] Inventor: Duane C. Uhri, Grand Prairie, Tex.

[73] Assignee: Mobil Oil Corporation, New York, N.Y.

[21] Appl. No.: 489,965

[22] Filed: Apr. 29, 1983

[51] Int. Cl.[3] ..... E21C 37/12

[52] U.S. Cl. ..... 299/17; 175/69

[58] Field of Search ..... 299/16, 17; 175/69, 175/72, 215

[56] References Cited

U.S. PATENT DOCUMENTS

| | | | |
|---|---|---|---|
| 2,518,591 | 8/1950 | Aston | 175/67 X |
| 3,030,086 | 4/1962 | Donaldson | 299/17 X |
| 3,393,013 | 7/1968 | Hammer | 299/17 |
| 4,035,023 | 7/1977 | Cockrell | 299/17 |

*Primary Examiner*—Stephen J. Novosad
*Assistant Examiner*—M. Goodwin
*Attorney, Agent, or Firm*—Alexander J. McKillop; Michael G. Gilman; Charles A. Malone

[57] ABSTRACT

A hydraulic borehole mining method and device used to recover subterranean coal, oil shale and other minerals from depths exceeding 1500 ft. where a gas lift is utilized to lift the mined slurry to the surface.

10 Claims, 3 Drawing Figures

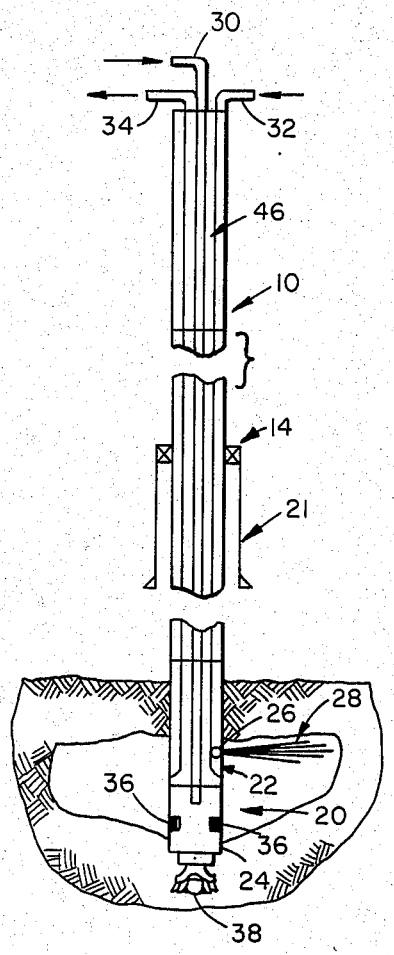
FIG. 1
FIG. 2
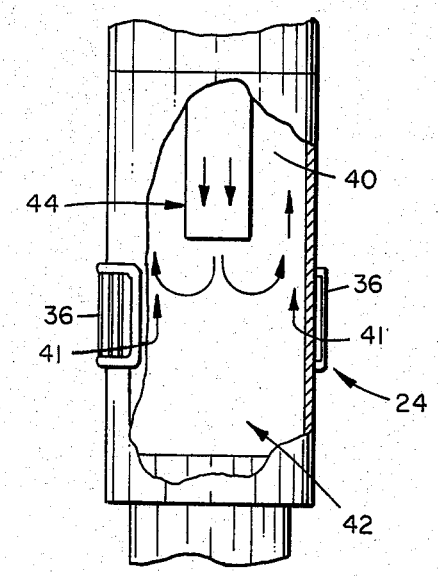
FIG. 3
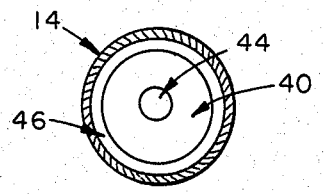

DEEP WELL PROCESS FOR SLURRY PICK-UP IN HYDRAULIC BOREHOLE MINING DEVICES

FIELD OF THE INVENTION

The present invention relates to a hydraulic and mechanical system for hydraulic borehole mining devices that provide a mode to lift mined slurries from deeper depths than previously possible.

BACKGROUND OF THE INVENTION

Hydraulic borehole mining devices of the type with which the present invention is concerned exhibit a good potential for mining underground coal, oil shale, tar sands, heavy oil sands, and other minerals from the ground surface with a minimum disturbance of the surface itself. This general technique involves the drilling of a borehole from the ground surface to the underground mineral deposit and the use of at least one high-pressure water jet produced by a jet nozzle directed to cut or otherwise provide fragmentation of the mineral deposit. A slurry jet pump is used to entrain, in a slurry, the fractured mineral particles, and to transport these particles back to the ground surface.

Heretofore, others have used hydraulic borebole mining devices to mine mineral particles at depths up to 500 feet. Fly, U.S. Pat. No. 3,155,177, which is hereby incorporated by reference, disclosed borehole mining to a 500 foot depth. This is set forth in column 21 at lines 66–69 of U.S. Pat. No. 3,155,177. Mining to this depth was accomplished via water pressure of a proper stream size and sufficient pressure generated through a pump means. Fly also disclosed increasing the ascending velocities of the jet pump discharge fluids by controllably injecting additional water in the well or mined reservoir. Additionally, Fly disclosed that materials such as liquid butane and propane commonly known as liquified petroleum gas could be used as the hydraulic liquid to maintain a substantially higher pressure in the venturi and maintain such material in the liquid state under the temperature and velocity conditions there existing. This is disclosed in U.S. Pat. No. 3,155,177 at column 19, lines 42–58.

Recovery of minerals by hydraulic mining and jet pumping of aqueous mineral slurries is well known. For example, Redford, U.S. Pat. No. 3,951,457, discloses the hydraulic method in which hot water or steam is introduced into a subterranean deposit at high velocity to dislodge bitumen and particles of sand from the surrounding mineral bed. The resulting aqueous pulp is pumped to the surface by means of another high velocity jet of hot water or steam. Pfefferle, U.S. Pat. No. 3,439,953, discloses another apparatus for hydraulic mining. The U.S. Department of the Interior, Bureau of Mines, has sponsored development of a tool for single borehole slurry mining in which a stream of cutting jet water is pumped at very high pressure to a point adjacent the bottom of the borehole and is directed generally laterally at very high velocity into the surrounding mineral body to dislodge the mineral and form an aqueous pulp. The aqueous pulp is conveyed to the surface using a jet pump powered by a second stream of high pressure, high velocity water. Additional information on this system is available to the public from Flow Industries, Inc., 21414 68th Ave. South, Kent, Wash, 98031. A pneumatic sampling apparatus in which mineral is sampled and conveyed from below and annular bottom opening is disclosed by Murrel, U.S Pat. No. 3,807,514.

Hodges, U.S. Pat. No. 4,275,926 discloses metering the flow of slurry at the orifice of the venturi by use of a feed screw. The metered flow was augmented by controlling the rotational speed of the tool through the surface drive unit, which in combination with the adjustable opening yields a maximum efficiency ratio of solids into the flow stream. This maximum efficiency ratio was dependent upon the particular composition and consistency of the mined material but was typically within the range of 10 to 50 percent solid to liquid.

A problem associated with hydraulic borehole mining tools operating in deep wells is the high volume of water or liquid required for the process. These high volumes of water produced in the process must be separated from the mined slurry which adds to the cost and efficiency of the process. Also, in some mining areas abundant water or required liquids might be unavailable.

To use conventional borehole devices to remove the mined particles at depths of from about 1000–2000 feet would require large capacity pumps and nozzles. This usage would result in costly equipment requirements. The present invention circumvents these requirements by using compressed natural gas or inert gases to serve as the lifting force to raise slurried mineral particles to the surface without the assistance of a slurry pump.

SUMMARY OF THE INVENTION

The present invention provides for a hydraulic borehole apparatus and process for the deep mining of minerals. As contemplated, the apparatus comprises at least one jet from which pressurized water is emitted, a slurry pick up and transport system including a plurality of particle inlets through which particles of materials cut by said jets are picked up, a gas lift which causes the slurried particles to be drawn into the apparatus through the inlets, admixed with the gas and transported to the surface. In order to maintain the pressure in the mining cavity, a rotary packing seal is provided for, which seal fits into the space between the circumference of the borehole mining tool and the casing for said tool.

A process is provided for removing hydraulically mined borehole materials to the surface by contacting the pressurized water jet stream in the area of the materials to be mined, causing a slurry to be formed after contacting the jet stream with the mined materials, pressurizing the mining cavity with cutting jet fluid, transporting said slurry to the surface by a gas lift after slurry entry into openings in the mining section of the borehole mining apparatus, and separating the slurry from the gas to recover mined materials, water and gas.

Other features and advantages of the invention will be set forth in, or apparent from, the detailed description of a preferred embodiment found hereinbelow.

BRIEF DESCRIPTION OF THE DRAWINGS

FIG. 1 is a schematic representation, in side elevation, of an exemplary hydraulic borehole mining device incorporating the present invention;

FIG. 2 is a detail, to an enlarged scale and partially broken away representation of the mixing section of the mining device shown in FIG. 3; and FIG. 3 is a cross sectional view of the borehole mining tool depicting the interrelationship of the concentric internal conduits.

DESCRIPTION OF THE PREFERRED EMBODIMENTS

Referring to FIG. 1, the overall configuration of an exemplary embodiment of a hydraulic borehole mining device is illustrated. The basic device can be of a form such as disclosed in U.S. Pat. No. 3,797,590 (Archibald et al.) or U.S. Pat. No. 3,155,177 (Fly) and these patents are hereby incorporated by reference. Reference will be made to these patents with respect to constructional details of such a device. For purpose of understanding the present invention, only the basic elements of the device will be described apart from those that provide a context, for, or make up part of, the present invention, it being understood that those parts which are not specifically described can take forms known in the art. Further, while the present invention will be described relative to the mining of oil shale, other uses are, of course, feasible.

The hydraulic borehole device illustrated in FIG. 1 preferably comprises an elongate shell or body (10) which is made up of a series of separate sections. The section of interest here is the so-called mining section, generally denoted (20), which is located at the lowermost end of body (10) and which itself is made up of a nozzle section (22) and a slurry intake and mixing section (24). Nozzle section (22) includes at least one jet nozzle (26), which produces an oil shale cutting water jet indicated at (28). Water for the jet is supplied from a high pressure source (not shown) by means of a conduit (32) at an exemplary pressure of about 1500 to about 2000 psi. for a mining depth of approximately 1500 ft. The mixing section (24), which is described in more detail hereinbelow, cooperates with a gas lift to provide for picking up of the dislodged particles which are cut away by the jet (28). These particles are transported in a slurry, with water for the slurry, at an exemplary pressure of from about 700 to about 800 psi, being supplied to the gas lift through an inlet conduit (30), and the slurry being removed through an outlet conduit (34). The dislodged particles are taken in the device through a series of screens (36) which are located about the circumference of the slurry intake and mixing section (24), as illustrated, and which serve in screening out oversized particles. A tricone bit (38) provides for the reduction of oversized particles. The casing for the borehole mining tool is indicated by (21). A rotary packing seal (14) is placed between the casing (21) and the body (10).

Referring to FIG. 2, a detail of the mixing section (24) is shown, FIG. 2 being partially broken away to illustrate the gas lift referred to above. As shown, the slurry intake and mixing section (24) includes a longitudinally extending conduit (40) which communicates with outlet (34) as in FIG. 1 and thus serves in transporting the slurried particles to the surface by conduit (40), as illustrated by arrows (41), to a chamber (42) located near the bottom of borehole mining device (10). Compressed gases which can be utilized for the gas lift include natural gas, propane, butane, carbon dioxide, nitrogen and any other gases produced or utilized in the refining of crude oils. Thus, the pressure reduction created by the gas lift (44) serves to draw the slurried mineral particles into the chamber (42).

FIG. 3 shows a cross sectional view of the borehole mining tool and depicts how the conduits are interrelated with one another. The gas lift conduit is represented by (44). In one embodiment of this invention, gas lift was found to be unnecessary since sufficient pressure could be generated within the mining cavity by the water from the cutting jet (28) to cause the slurry thereby formed to be emitted to the surface via conduit (40). The rotary packing seal (14) serves to prevent pressure loss. In pressurizing the mining cavity, the pressure is maintained above the reservoir pressure and below the hydraulic fracturing pressure.

These pressures of course will vary depending upon the geological formations in the area to be mined and the mining depth. However, it has been determined that the most efficient operation is obtained when the particle or solid concentration is maintained between 5% and 38% in the absence of a gas lift. Velocities of the exiting slurry should be maintained between 8 ft./sec. to 30 ft./sec. Sufficient water enters the formation through conduit (46) to maintain the slurry concentration at the desired level. This conduit (46) is connected with the cutting jet Nozzle (26) as shown in FIG. 1. Velocities of the exiting slurried particles are controlled by selecting the cross sectional area of the conduit (41), the cutting jet flow rate and pressure, and the gas lift flow rate and pressure so as to generate sufficient pressure to exceed the reservoir pressure but not so much as to exceed the hydraulic fracturing pressure of the formation. For mining at a rate of 100 tons per hour the effective cross sectional area of conduit (40) should be about 37 sq. inches when mining at a depth of 1500 feet. Sufficient water should be delivered through jet (26) to maintain a slurried particle concentration of 5% to 38%.

The table below denotes examples of three mining tools which can be used to mine desired minerals at a depth of 1500 feet and 100 tons, 200 tons, and 300 tons per hour.

TABLE

| | Mining Rate | Slurry Conduit | Water Conduit |
|---|---|---|---|
| Tool No. 1 12 inches nominal outside diameter | 100 tons/hr | 6.8 inches effective inside diameter or 36.8 sq. in. | 7.6 inches effective inside diameter or 45.5 sq. in. |
| Tool No. 2 16 inches nominal outside diameter | 200 tons/hr | 9.8 inches effective inside diameter or 74.8 sq. in. | 9.7 inches effective inside diameter or 74.4 sq. in. |
| Tool No. 3 20 inches nominal outside diameter | 300 tons/hr | 12.3 inches effective inside diameter or 119.7 sq. in. | 12.6 inches effective inside diameter or 124.7 sq. in. |

In the preferred embodiment of this invention a gas lift is used. Here the exemplary mining depth is 1500 feet. Gas is injected at a rate up to 50 SCF/barrel of slurry which is sufficient to lift the slurry at a slurry velocity of at least 8 ft./sec. but no greater than 30 ft./sec. The concentration of the slurried particles or solids can vary from 23% to 50%. The vertical lift pressure must exceed the reservoir pressure but cannot exceed the hydraulic fracturing pressure otherwise the cavity pressure will drop and the cavity will collapse. By using a gas lift instead of a jet pump with water, the volumes of water are greatly reduced. The volume of water is also reduced by controlling the jet cutting water to obtain a more concentrated slurry. It has also been determined that dislodging of materials can occur even when the cutting jet is operated in a submerged condition in the cutting fluid.

Although the invention has been described relative to an exemplary embodiment thereof, it will be understood by those skilled in the art that variations and modifications can be effected in this embodiment without departing from the scope and spirit of the invention.

What is claimed is:

1. In an improved hydraulic mining process where a borehole mining tool contained within a rotary packing seal substantially near the surface is rotated by a drill string into a subterranean deposit and hydraulically dislodges mineral bearing deposits therefrom by a directed hydraulic jet causing a slurry to be formed and brought to the surface, the improvement comprising:

(a) determining the hydraulic fracturing pressure of the subterranean cavity being formed during the mining process;

(b) determining the cavity pressure thus formed;

(c) pressurizing the cavity to a pressure above the reservoir pressure but below the hydraulic fracturing pressure;

(d) causing the velocity of the slurry exiting the slurry conduit to be from about 8 feet/second to about 30 feet/second by adjusting the cavity pressure alone and when required by using gas lift;

(e) maintaining the exiting slurry concentration so that the mined minerals or solids therein contained are in an amount of from about 5% by volume to about 50% by volume; and (f) using an immobile slurry conduit with respect to said tool and sized with respect to the slurry concentration to be mined and the mining rate.

2. A claim as claimed in claim 1, where in step (d) natural gas is used for gas lift.

3. A claim as claimed in claim 1, where in step (d) propane gas is used for gas lift.

4. A claim as claimed in claim 1 where in step (d) carbon dioxide is used for gas lift.

5. A claim as claimed in claim 1 where in step (d) nitrogen is used for gas lift.

6. A claim as claimed in claim 1 where in step (d) refinery process gas is used for gas lift.

7. A claim as claimed in claim 1 where in step (e) the solids concentration in the exiting slurry is maintained from about 20% by volume to about 50% by volume.

8. In an improved hydraulic borehole mining tool or apparatus containing a nozzle section, and a mining section with a tricone bit used for extended reach mining, the improvement comprising;

(a) a first internal immobile concentric conduit with respect to said tool for the admittance of pressurized gas into the mining section which conduit's terminus is placed in close proximity to the slurry inlet;

(b) a rotary packing seal which is placed around the exterior circumference of the borehole mining tool near the surface where the tool exists the borehole;

(c) a means in the tool for pressurizing the cavity formed by high pressure water ejected from at least one nozzle in the nozzle section; and (d) a second immobile concentric conduit (40) with respect to said tool which is positioned around the first internal concentric conduit (44) which second conduit (40) terminates in the mining section and is fluidly connected with the mining section and closely connected with a third immobile concentric conduit (46) with respect to said tool which forms an annulus with said second conduit and serves as a conduit for the high pressure cutting water exiting through the nozzle section.

9. An apparatus as claimed in claim 8 where in part (d) the second concentric conduit (40) varies from about 37 square inches to about 120 square inches.

10. An apparatus as claimed in claim 8 where in part (d) the third concentric conduit (46) varies from about 45 square inches to about 125 square inches.

* * * * *